US007187264B2

(12) United States Patent
Bieck et al.

(10) Patent No.: US 7,187,264 B2
(45) Date of Patent: Mar. 6, 2007

(54) FOIL-TYPE SWITCHING ELEMENT WITH IMPROVED SPACER DESIGN

(75) Inventors: Werner Bieck, Wiltingen (DE); Dries Chabach, Noertrange (LU); Yves Decoster, Ethe (BE); Robert Ollett, Flint, MI (US); Alain Schumacher, Mertert (BE)

(73) Assignee: IEE International Electronics & Engineering S.A., Echternach (LU)

( * ) Notice: Subject to any disclaimer, the term of this patent is extended or adjusted under 35 U.S.C. 154(b) by 0 days.

(21) Appl. No.: 10/370,446

(22) Filed: Feb. 20, 2003

(65) Prior Publication Data

US 2004/0163939 A1 Aug. 26, 2004

(51) Int. Cl.
*H01C 10/10* (2006.01)

(52) U.S. Cl. ..... 338/47; 338/99

(58) Field of Classification Search ..... 338/47–49, 338/99, 101, 111–114, 36, 42; 200/512, 200/513, 83 A, 85 A; 73/862.042, 700, 715, 73/754

See application file for complete search history.

(56) References Cited

U.S. PATENT DOCUMENTS

| | | | | |
|---|---|---|---|---|
| 2,445,660 | A * | 7/1948 | Bruestle | 338/114 |
| 4,382,165 | A * | 5/1983 | Balash et al. | 200/5 A |
| 4,503,705 | A * | 3/1985 | Polchaninoff | 73/172 |
| 4,952,761 | A * | 8/1990 | Viebrantz | 200/513 |
| 5,014,224 | A * | 5/1991 | Hans | 338/99 |
| 5,810,604 | A * | 9/1998 | Kopp et al. | 200/512 |
| 5,912,612 | A * | 6/1999 | DeVolpi | 338/95 |
| 5,962,118 | A * | 10/1999 | Burgess | 428/308.4 |
| 6,373,373 | B1 * | 4/2002 | Saito | 338/47 |
| 6,388,556 | B1 * | 5/2002 | Imai et al. | 338/114 |
| 6,505,521 | B1 * | 1/2003 | Petri et al. | 73/862.042 |
| 6,531,951 | B2 * | 3/2003 | Serban et al. | 338/47 |
| 6,774,331 | B1 * | 8/2004 | Den Ridder et al. | 200/512 |
| 2003/0043014 | A1 * | 3/2003 | Nakazawa et al. | 338/47 |
| 2005/0006216 | A1 * | 1/2005 | Federspiel | 200/512 |

* cited by examiner

*Primary Examiner*—Tu Hoang
(74) *Attorney, Agent, or Firm*—McCormick, Paulding & Huber LLP

(57) ABSTRACT

A foil-type switching element comprises a first carrier foil and a second carrier foil arranged at a certain distance from each other by means of a spacer 10. The spacer 10 comprises at least one recess 12 defining an active area of the switching element. At least two electrodes and a layer of pressure sensitive material are arranged within the active area of the switching element between the first and second carrier foils in such a way that, in response to a pressure acting on the active area of the switching element, the first and second carrier foils are pressed together against the reaction force of the elastic carrier foils and an electrical contact is established between the at least two electrodes via the pressure sensitive material. The active area comprises an inner region 14 and a number of outer regions 18, the inner region having a generally convex shape and the outer regions extending outwardly from said inner region.

13 Claims, 3 Drawing Sheets

FOIL-TYPE SWITCHING ELEMENT WITH IMPROVED SPACER DESIGN

Figure 1:
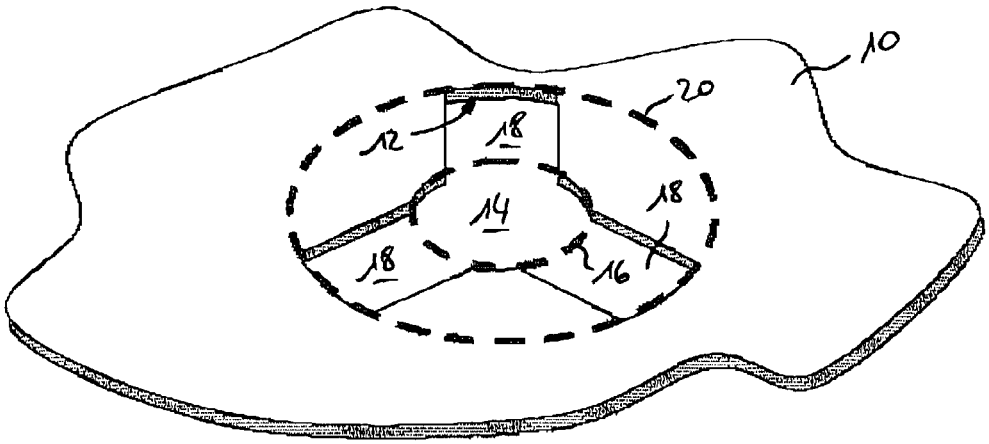

The present invention relates to foil-type switching elements and more specifically to foil-type pressure sensors.

The present invention relates to a foil-type pressure sensor of the type having an electrical resistance, which varies with the amount of pressure applied. Pressure sensors of this type usually comprise a first carrier foil and a second carrier foil arranged at a certain distance from each other by means of a spacer. The spacer comprises at least one recess, which defines an active area of the switching element. At least two electrodes and a layer of pressure sensitive material are arranged within the active area of the switching element between said first and second carrier foils in such a way that, in response to a pressure acting on the active area of the switching element, the first and second carrier foils are pressed together against the reaction force of the elastic carrier foils and an electrical contact is established between the at least two electrodes via the pressure sensitive material.

Such pressure sensors can be manufactured cost-effectively and have proven to be extremely robust and reliable in practice.

The electrical response of such a switching element depends on the type and shape of the electrodes and the layer of pressure sensitive material, their arrangement within the active area of the switching element and finally on the physical contact, which is established between the electrodes in response to a force acting on the active area. The physical contact between the electrodes is determined by the mechanical response of the switching element in case of a force acting on the active area. This mechanical response can be described by a membrane model. The deflection of the membrane is proportional to the pressure acting vertically on the membrane and depends on the elastic properties of the membrane, its thickness and the radius of the restraining device.

It follows that the electrical response of the switching element starts above a certain minimum pressure, at which a physical contact between the electrodes and the layer of semi-conducting material is initially established. Above this so-called turn-on-point, the electrical response is mainly determined by the area of the contact surface between the electrodes and the semi-conducting layer.

In know pressure sensors, the active area has a generally circular shape, i.e. the recess in the spacer has a circular shape. In this case, the radial expansion of the mechanical contact surface area is essentially a specific function of the force exerted on the switching element and an essentially quadratic dependence of this radius is obtained for the area of the contact surface. The resistance behavior of the sensor as a function of the force consequently exhibits a characteristic determined by this quadratic dependence, which renders the sensors unsuitable for particular applications.

Furthermore, certain applications of pressure sensors require the turn-on point of the sensor to be rather high in order to avoid a preload on the sensor. This is e.g. the case for sensors, which are arranged underneath a cover material, especially if the cover material is rather rigid and/or strongly taut above the switching element. In this case, the turn-on point has to be adjusted by reducing the size of the membrane restraining device, i.e. of the spacer recess, which defines the active area. Unfortunately, the use of a small diameter spacer recess adversely affects the dynamic of the sensor cell and may even lead to the complete disappearance of the mechanical cell dynamic.

OBJECT OF THE INVENTION

The object of the present invention is to provide a switching element with improved electrical response.

GENERAL DESCRIPTION OF THE INVENTION

This object is solved by a foil-type switching element according to the present invention.

A foil-type switching element typically comprises a first carrier foil and a second carrier foil arranged at a certain distance from each other by means of a spacer, said spacer comprising at least one recess defining an active area of the switching element. At least two electrodes and a layer of pressure sensitive material are arranged within the active area of the switching element between said first and second carrier foils in such a way that, in response to a pressure acting on the active area of the switching element, the first and second carrier foils are pressed together against the reaction force of the elastic carrier foils and an electrical contact is established between the at least two electrodes via the pressure sensitive material. According to the invention said active area comprises an inner region and a number of outer regions, said inner region having a generally convex shape and said outer regions extending outwardly from said inner region.

In contrast to the known pressure sensors, the radial expansion of the mechanical contact surface area of the pressure sensor of the present invention is no longer a simple function of the force exerted on the switching element. In fact, due to the design of the active area with two regions, the radial expansion of the contact surface shows a different behavior for higher forces than for small forces acting on the pressure sensor. Only at the beginning of an activation of the sensor, i.e. for small forces acting on the sensor, the mechanical response of the sensor is comparable to the behavior of the known sensors. During this initial activation, the inner region of the active area determines the mechanical response. Once the turn-on point of the sensor is reached, the first and second carrier foils come into physical contact such that an electrical contact may be established between electrodes and a layer of pressure sensitive material, which are typically arranged in the active area of the switching element between said first and second carrier foils.

If the force acting on the sensor further increases, the area of physical contact between the first and second carrier foil reaches the outer periphery of the inner region of the active area. Beyond this point, the mechanical response of the sensor cell is mainly determined by the shape of the outer regions of the active area, which extend outwardly from the inner region of the active area. In these outer regions, the mechanical configuration of the above described membrane model is in fact considerably different compared to the configuration of the inner region. It follows that the area of the contact surface is no longer determined y the typical quadratic dependence of the radius of the contact surface as in known sensors.

Accordingly, the pressure sensor of the present invention shows a hybrid mechanical response, which is determined by the convex shape of the inner region for small forces while the shape of the outer regions determines the mechanical response for higher forces. Such hybrid response can however be used in order to optimize the dynamic of the sensor cell. In fact, the shape and dimension of the inner region of the active area is mainly responsible for the setting of the turn-on point of the sensor cell, while the shape and size of the outer regions mainly determines the dynamic of the sensor above the turn-on point. Thus by individually adjusting the shape and dimension of the inner and outer regions of the active area, the turn-on point and the dynamic of the sensor cell can be individually adjusted. If e.g. a sensor with high turn-on point should be provided, the dimension of the inner region of the active area can be reduced. At the same time, the shape and dimension of the outer regions may be adjusted in order to provide a suitable dynamic of the sensor for the specific application of the sensor.

It will be appreciated, that the proposed design of the spacer recess results in a decoupling of the mechanical and dimensional requirements for adjusting the turn-on point from those for adjusting the dynamic of the cell. Hence, each of the two cell characteristics can be independently adjusted over a wide range without negatively affecting the respective other characteristic. It should be noted that this decoupling positively affects the possible sensor configurations. In fact, as the turn-on point of the present sensor cell may be adjusted without negatively affecting the dynamic of the cell, it is now e.g. possible to use spacers having a reduced thickness.

In known pressure sensors, the spacer recess is required to have a sufficient thickness (90 μm or higher) in order to guarantee a suitably high turn-on point despite of the required large diameter of the spacer recess. Now, with the pressure sensor of the present invention, the thickness of the spacer is no longer the limiting parameter for adjusting the turn-on point of the sensor cell. Hence, spacers having reduced thickness of less than 90 μm may be used without inevitably impair the sensor cells characteristics. This advantage enables the use of screen-printed spacers, i.e. printable glue that is applied in a screen-printing process on one of the carrier foils. The thickness of such a screen-printed spacer can under normal conditions not be as high than that of a double-sided adhesive tape, which is usually used as spacer material.

It follows that the form of the active area of the switching element of the present invention is specifically designed in order to improve the electrical response of the sensor. It will be noted that the recess in the spacer defines the form of the active area. Accordingly, the recess has to be properly shaped in order to provide the required mechanical configuration of the sensor cell. It will be appreciated that the recess can be easily provided in a screen printing process for a printed spacer or in case of a double-sided adhesive tape spacer material e.g. in a punching process.

In a preferred embodiment of the invention, said inner region comprises a generally circular shape. Such a circular design confers an isotropic behavior to the sensor, which has proven to be very suitable for controlling the initial contact between the first and second carrier foil. Furthermore, a circular recess in the spacer is very easy to manufacture.

The deflection of a membrane under the action of a force propagates radially from the point of action of the force towards the outer restraining device of the membrane. It follows that the outer regions extend preferably radially from said inner region so that deflection of the membrane is not restricted at the boundary between inner and outer region of the active area.

In order to provide a generally isotropic mechanical response of the sensor cell, said outer regions are preferably equally distributed over a periphery of said inner region. In other words, the outer regions are preferably arranged so that the design of the active area shows a rotational symmetry about an axis passing by the center of the active cell. In order to increase the dynamic of the sensor cell, the degree of rotational symmetry is advantageously odd which implies that the number of said outer regions is odd, e.g. three.

In a preferred embodiment of the invention, the outer regions comprise a generally elongated shape. The outer regions may e.g. comprise a generally triangular shape or a generally trapezoidal shape, said outer regions converging from said inner region towards an outer periphery of said active area. Alternatively, the outer regions may comprise a generally rectangular shape.

It should be noted that the width of the outer regions of the active area is preferably chosen so as to ensure a smooth transition in the mechanical behavior between the inner and outer regions of the active area.

In one embodiment of such pressure sensors (shown in FIG. 5*a*), a first electrode 30 is arranged on an inner surface of said first carrier foil 32 and a second electrode 34 is arranged on an inner surface of the second carrier foil 36 in a facing relationship with said first electrode 30. At least one of said first 30 and second electrode 34 is fully or partially covered by said layer of pressure sensitive material 38 e.g. a semi-conducting or resistive material, such that when the first and second carrier foils 32, 36 are pressed together in response of a force acting on the switching element, an electrical contact is established between the first 30 and second electrode 34 via the layer of pressure sensitive material 38. The pressure sensors of this type are frequently called to operate in a so called "through mode".

In another embodiment of pressure sensors (shown in FIG. 5*b*), a first 40 and a second 44 electrode are arranged in spaced relationship side by side on an inner surface of said first carrier foil 42 while a layer of pressure sensitive material 48 is arranged on an inner surface of the second carrier foil 46. The layer of pressure sensitive material 48 is arranged in facing relationship with said first and second electrodes 40, 44 such that, when said first and second carrier foils 42, 46 are pressed together in response to a force acting on the active area of the switching element, the layer of pressure sensitive material 48 shunts the first and second electrode 40, 44. These sensors are called to operate in the so-called "shunt mode".

It should be noted that depending on the application of the sensor cell, the electrodes may have a planar shape covering e.g. the respective carrier foil on essentially the entire active area or the electrodes may comprise a plurality of suitably shaped interconnected conductors, e.g. in a comb-like pattern or having opened circular conductors, whereby the conductors of the first and second electrodes may be arranged in an interleaving arrangement. It will further be appreciated that the layer of pressure sensitive material may have a specific design, which is adapted to the application of the sensor. In other words, the layer of pressure sensitive material may cover the respective carrier foil or electrode over essentially the entire active area or this layer may only be applied to selected regions of the active area.

During the manufacturing process, the electrodes are usually printed onto their respective carrier foil. During this printing process, the carrier foil is subject to surface tensions on the boundary to the conductive material of printed electrode. These surface tensions may lead to a deformation of the carrier foil and thus to an alteration of the cell's response. It will be appreciated that the present non-circular spacer recess design considerably reduces the effect of the deformation on the cells response.

DETAILED DESCRIPTION WITH RESPECT TO THE FIGURES

Figure 2:
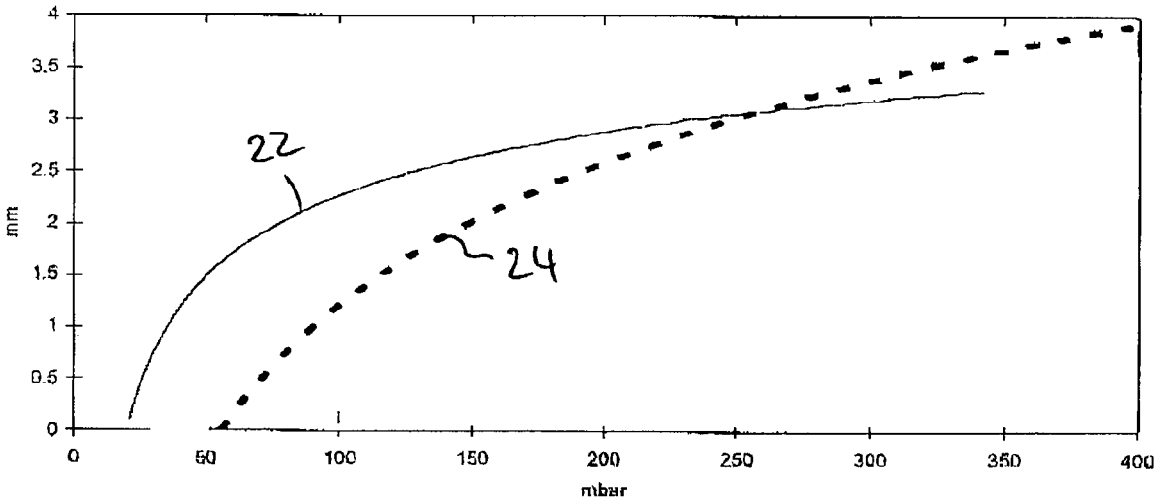
Figure 3A:
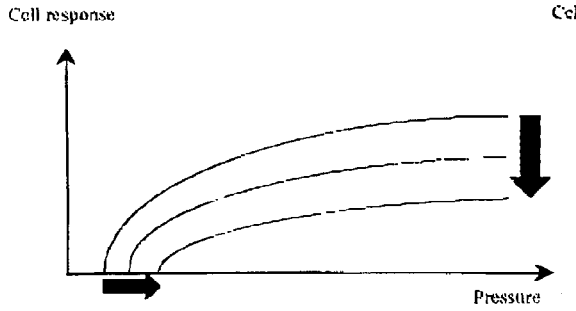
Figure 3B:
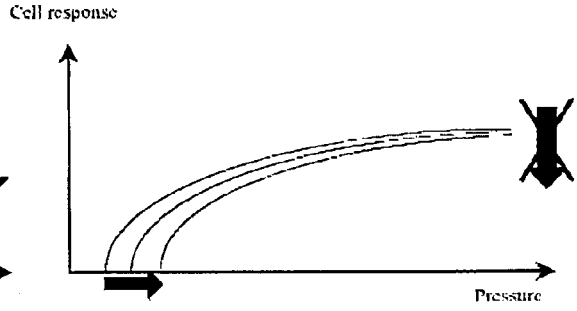
Figure 4A:
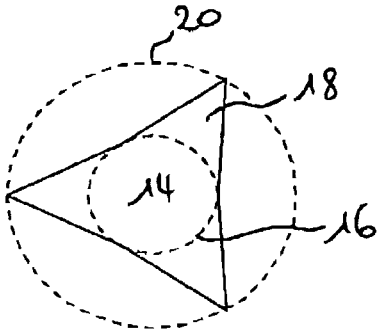
Figure 4B:
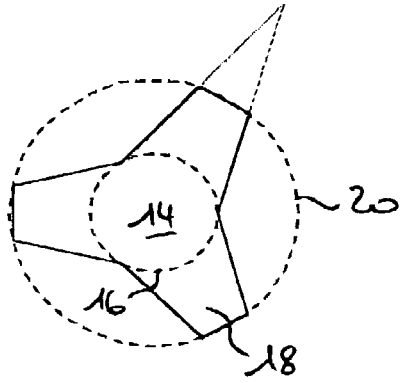
Figure 4C:
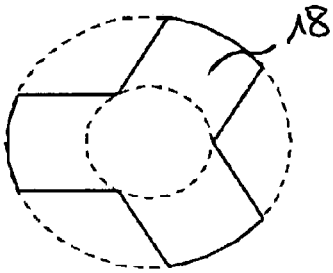

The present invention will be more apparent from the following description of several not limiting embodiments with reference to the attached drawings, wherein FIG. 1 is an embodiment of a spacer of a foil-type switching element having a suitable recess;

FIG. 2 is a comparison of the variation of the radius of the contact surface between the carrier foils of a prior art sensor cell and a sensor cell according to the present invention;

FIGS. 3*a*–3*b* show the influence of the adjustment of the turn-on point on the dynamic of the sensor cell for a state of the art sensor (FIG. 3*a*) and for a sensor according to the present invention (FIG. 3*b*);

FIGS. 4*a*–4*c* show different embodiments for the shape of the active area of a foil-type switching element according to the present invention.

Figure 5A:
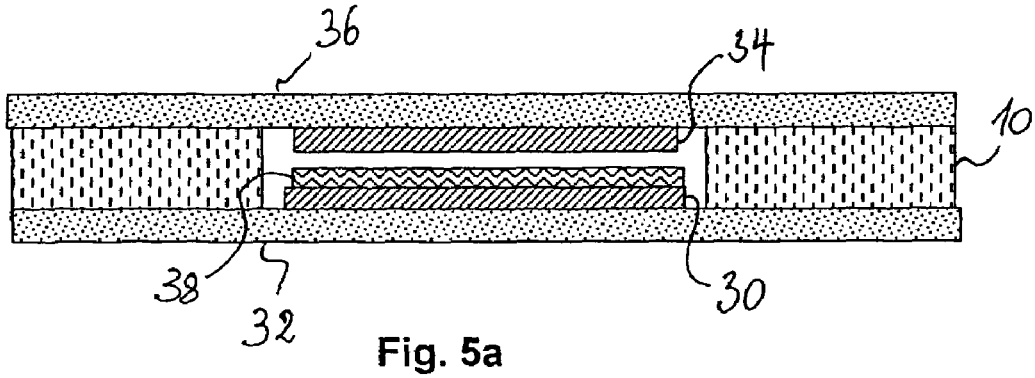
Figure 5B:
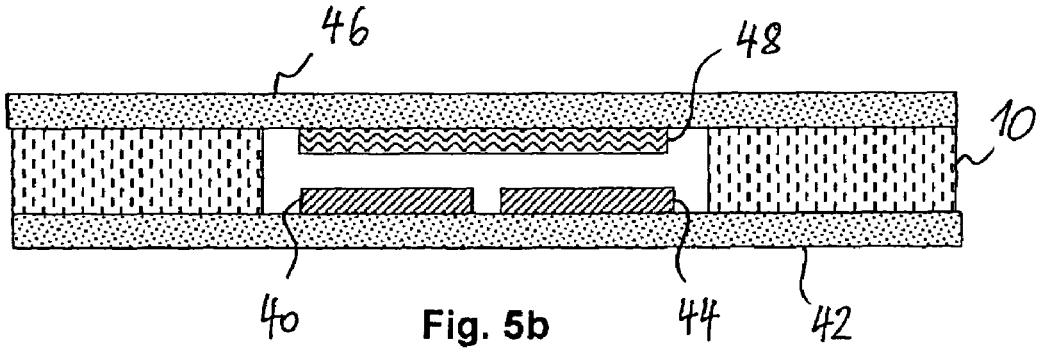

FIGS. 5*a*–5*b* are cross sectional views of different embodiments of foil-type switching elements.

The present invention relates to a foil-type pressure sensor of the type having an electrical resistance, which varies with the amount of pressure applied. Pressure sensors of this type usually comprise a first carrier foil and a second carrier foil arranged at a certain distance from each other by means of a spacer. The spacer comprises at least one recess, which defines an active area of the switching element. At least two electrodes and a layer of pressure sensitive material are arranged within the active area of the switching element between said first and second carrier foils in such a way that, in response to a pressure acting on the active area of the switching element, the first and second carrier foils are pressed together against the reaction force of the elastic carrier foils and an electrical contact is established between the at least two electrodes via the pressure sensitive material.

FIG. 1 shows an embodiment of a spacer 10 according to the present invention. The spacer comprises a recess 12, which defines the active area of the sensor cell. The recess 12 comprises an inner region 14 having a generally convex shape. In the shown embodiment, the inner region has a circular shape, which is graphically presented by an inscribed circle 16. The dimension of this inner area is responsible for the turn-on point of the sensor cell.

Further to the inner convex region, the recess 12 of the shown spacer comprises three outer regions 18, which extend radially outwardly from the inner region 14. The outer regions 18 have a generally elongated rectangular shape and extend from the inner region 14 towards an outer periphery of the active area, which is presented by the circumscribed circle 20. The shape of the outer regions 18 and the dimension of the circumscribed circle 20 determine the dynamic of the pressure sensor.

In the shown embodiment, the outer regions are equally distributed over the periphery of the inner region 14 of the active area. It follows that the recess 12 of the spacer shows a triangular rotational symmetry.

FIG. 2 shows the difference between the dynamic of a state of the art sensor and a sensor having an active area according to the present invention. The known state of the art sensor typically has a circular active area. The radial expansion of the mechanical contact surface area between the carrier foils in case of such an active area is essentially a specific function of the force exerted on the switching element and an essentially quadratic dependence of this radius is obtained for the area of the contact surface. The radius of the surface of contact versus the pressure acting on the sensor cell for such a pressure sensor is plotted in a continuous line in FIG. 2 and referenced by the numeral 22. This graph 22 shows a turn-on point at very small forces and a steep increase of the radius immediately above the turn-on point. On the other hand, the variation of the radius of the contact surface for higher forces is very small, i.e. the dynamic of the cell is poor for higher forces.

FIG. 2 also shows a graph for a pressure sensor having the improved spacer design of the present invention. The graph is plotted for an active area, the outer dimension of which is comparable to the dimension of the active area of the state of the art active area. This graph is shown in dashed line and generally referenced as 24. Compared to graph 22, graph 24 shows a turn-on point at a much higher force. This behavior can be controlled by suitably dimensioning the inner region 14 of the spacer recess 12. On the other hand, the increase of the radius of the contact surface immediately above the turn-on point is less steep than with the state of the art sensor but a considerable variation of the radius prevails up to large forces. It follows that the dynamic of the improved cell over the entire force range is considerably enhanced with respect to the known sensors.

A further advantage of the present switching element is illustrated in FIGS. 3*a*–3*b*. FIG. 3*a* shows the influence of the adjustment of the turn-on point for a traditional sensor. In order to increase the turn-on point of a traditional sensor, the radius of the active area has to be reduced. Such a reduction of the active area however negatively affects the dynamic of the cell as shown by the different graphs in FIG. 3*a*. In a sensor according to the present invention, the turn-on point may be adjusted without affecting the dynamic of the cell. In fact, by reducing the dimension of the inner region 4 of the active area, the turn-on point of the senor may be shifted towards higher forces, while the dynamic of the cell, which is mainly determined by the outer regions of the active area, is maintained. Depending on the shape of the inner and outer regions, the reduction of the radius of the inner region may be accompanied by an adaptation of the dimension and/or the shape of the outer regions in order to guarantee a specific mechanical behavior of the cell.

FIG. 4*a*–4*c* shows different embodiments for the shape of the active area of a foil-type switching element according to the present invention. The outer regions 18 of the active area preferably comprise a generally elongated shape. The outer regions may e.g. comprise a generally triangular shape (FIG. 4*a*) or a generally trapezoidal shape (FIG. 4*b*). The trapezoidal shape shall be oriented so that the outer regions converge from said inner region 14 towards the outer periphery 20 of said active area (see FIG. 4*b*). Alternatively, the outer regions may comprise a generally rectangular shape (FIG. 4*c*).

It should be noted that the width of the outer regions 18 of the active area is preferably chosen so as to ensure a smooth transition in the mechanical behavior between the inner and outer regions of the active area.

What is claimed is:

1. A Foil-type pressure sensor having an electrical resistance which varies with the amount of pressure applied comprising:

a first carrier foil and a second carrier foil arranged at a certain distance from each other by means of a spacer, said spacer comprising at least one recess defining an active area of the pressure sensor; wherein the form of said recess is such that said active area comprises an inner region and a number of outer regions, said inner region having a generally convex shape to provide mechanical response for small forces of pressure and to set of turn-on points, and said outer regions extending outwardly from said inner region to provide mechanical response for higher forces of pressure, said outer regions having predetermined widths to ensure smooth transition in mechanical behavior between the inner region and the outer regions of said active area; and at least two electrodes and a layer of pressure sensitive material, said electrodes and said layer of pressure sensitive semiconductor material being centrally arranged within the active area of the pressure sensor between said first and second carrier foils so as to be at least partially located within the inner region of the active area.

2. Foil-type pressure sensor according to claim 1, wherein said inner region comprises a generally circular shape.

3. Foil-type pressure sensor according to claim 1, wherein said outer regions extend radially from said inner region.

4. Foil-type pressure sensor according to claim 1, wherein said outer regions are equally distributed over a periphery of said inner region.

5. Foil-type pressure sensor according to claim 1, wherein said outer regions comprise an elongated shape.

6. Foil-type pressure sensor according to claim 1, wherein said outer regions comprise a generally triangular shape.

7. Foil-type switching element according to claim 1, wherein said outer regions comprise a generally trapezoidal shape, said outer regions converging from said inner region towards an outer periphery of said active area.

8. Foil-type pressure sensor according to claim 1, wherein said outer regions comprise a generally rectangular shape.

9. Foil-type pressure sensor according to claim 1, wherein the number of said outer regions is odd.

10. Foil-type pressure sensor according to claim 1, wherein the shape and/or the dimension of said inner region and said outer region are adjusted so as to ensure a smooth transition in the mechanical behavior between the inner and outer regions of the active area.

11. Foil-type pressure sensor according to claim 1, wherein a first electrode is arranged on an inner surface of said first carrier foil and a second electrode is arranged on an inner surface of the second carrier foil in a facing relationship with said first electrode and wherein at least one of said first and second electrode is fully or partially covered by a layer of pressure sensitive material.

12. Foil-type pressure sensor according to claim 1, wherein a first and a second electrode are arranged side by side on an inner surface of said first carrier foil and wherein a layer of pressure sensitive material is arranged on an inner surface of the second carrier foil in facing relationship with said first and second electrodes.

13. Foil-type pressure sensor according to claim 1, wherein said spacer comprises a printable spacer material.

* * * * *

UNITED STATES PATENT AND TRADEMARK OFFICE

CERTIFICATE OF CORRECTION

PATENT NO. : 7,187,264 B2
APPLICATION NO. : 10/370446
DATED : March 6, 2007
INVENTOR(S) : Werner Bieck et al.

It is certified that error appears in the above-identified patent and that said Letters Patent is hereby corrected as shown below:

Title Page (Item 75) - Inventors:
Line 1, after "(DE);" please delete "Dries", and insert -- Driss -- as the second named inventor is "Driss Chabach".

Claim 1:
Column 7, line 9, after "sensitive", please delete "semiconductor".

Signed and Sealed this

Twelfth Day of February, 2008

JON W. DUDAS
*Director of the United States Patent and Trademark Office*

UNITED STATES PATENT AND TRADEMARK OFFICE

CERTIFICATE OF CORRECTION

PATENT NO. : 7,187,264 B2
APPLICATION NO. : 10/370446
DATED : March 6, 2007
INVENTOR(S) : Werner Bieck et al.

It is certified that error appears in the above-identified patent and that said Letters Patent is hereby corrected as shown below:

Title Page (Item 75) - Inventors:

Line 1, after "(De);" please delete "Dries", and insert -- Driss -- as the second named inventor is "Driss Chabach".

Claim 1:

Column 7, line 9, after "sensitive", please delete "semiconductor".

Signed and Sealed this

Nineteenth Day of February, 2008

JON W. DUDAS
*Director of the United States Patent and Trademark Office*